US005211620A

United States Patent [19]

Ratzel et al.

[11] Patent Number: 5,211,620

[45] Date of Patent: May 18, 1993

[54] EDGE-TENSION CONTROLLING DEVICE FOR A CUSHIONING CONVERSION MACHINE

[75] Inventors: Richard O. Ratzel, Westlake; James A. Simmons, Willoughby, both of Ohio

[73] Assignee: Ranpak Corp., Concord Township, Lake County, Ohio

[21] Appl. No.: 786,573

[22] Filed: Nov. 1, 1991

[51] Int. Cl.[5] ..... B31D 5/00; B31D 5/04

[52] U.S. Cl. ..... 493/346; 493/369; 493/407; 493/440; 493/464; 493/967

[58] Field of Search ..... 493/22, 381, 386, 346, 493/349, 369, 370, 372, 407, 439, 440, 464, 967

[56] References Cited

U.S. PATENT DOCUMENTS 2,569,589 10/1951 Trissell .
2,721,709 10/1955 Auerbacher .
2,860,703 11/1958 O'Donnell .
3,069,107 12/1962 Hirt .
3,136,462 6/1964 Knutson .
3,238,852 3/1966 Fial .
3,283,874 11/1966 Goreham .
3,509,797 5/1970 Johnson .
3,603,216 9/1971 Johnson .
3,655,500 4/1972 Johnson .
3,682,696 8/1972 Yasuda .
3,880,372 4/1975 Witte .
3,899,166 8/1975 Behn .
4,026,198 5/1977 Ottaviano .
4,059,256 11/1977 Palmer .
4,109,040 8/1978 Ottaviano .
4,237,776 12/1980 Ottaviano .
4,258,846 3/1981 Campo .
4,557,716 12/1985 Ottaviano .
4,717,613 1/1988 Ottaviano .
4,750,896 6/1988 Komaransky et al. .
4,839,210 6/1989 Komaransky et al. .
4,884,999 12/1989 Baldacci .
4,937,131 6/1990 Baldacci et al. .
4,968,291 11/1990 Baldacci et al. .

*Primary Examiner*—Bruce M. Kisliuk
*Assistant Examiner*—Jack Lavinder
*Attorney, Agent, or Firm*—Calfee, Halter & Griswold

[57] ABSTRACT

A cushioning conversion machine for converting a sheet-like stock material, which may be viewed as having two edge sections and a central section, into a cushioning product is provided. The machine includes a conversion assembly for converting the sheet-like stock material into a cushioning product and a supply assembly which supplies the sheet-like stock material to the conversion assembly. The stock material is supplied to the conversion assembly in such a manner that its edge sections must travel in a longer path than the central section thereby creating edge-tension in the edge sections of the stock material. While a certain minimum conversion-tension is necessary in the edge sections of the stock material to properly convert the stock material into a cushioning product, a certain continuous tearing-tension, greater than the minimum conversion-tension, will cause a continuous tear in the stock material. To insure that the edge-tension is not so great as to cause continuous tearing but is great enough to allow proper conversion, the supply assembly includes an edge-tension controlling device which controls the edge-tension so that it is greater than or equal to the minimum conversion-tension and less than the continuous tearing-tension.

17 Claims, 2 Drawing Sheets

EDGE-TENSION CONTROLLING DEVICE FOR A CUSHIONING CONVERSION MACHINE

FIELD OF THE INVENTION

This invention relates generally as indicated to an edge-tension controlling device for a cushioning conversion machine. More particularly, the present invention relates to an edge-tension controlling device which controls the tension in the edge sections of a sheet-like stock material in a manner which eliminates continuous tears without sacrificing the quality of the product created therefrom.

BACKGROUND AND SUMMARY OF THE INVENTION

In the process of shipping an item from one location to another, a protective packaging material is typically placed in the shipping case, or box, to fill any voids and/or to cushion the item during the shipping process. Plastic foam peanuts and plastic bubble pack are two types of conventionally used packaging materials and these plastic materials, while performing acceptably in many packaging applications, are not without disadvantages. For example, one drawback of plastic bubble film is that it usually includes a polyvinylidene chloride coating which prevents the plastic film from being safely incinerated thereby creating disposal difficulties for some industries. Additionally, both the plastic foam peanuts and the plastic bubble pack have a tendency to generate a charge of static electricity which attracts dust from the surrounding packaging site. Furthermore, these plastic materials sometimes themselves produce a significant amount of packaging "lint." Such dust and lint particles are generally undesirable and may even be destructive to sensitive merchandise such as electronic or medical equipment.

However, perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alternative. Paper is biodegradable, recyclable and renewable thereby making it an environmentally responsible choice for conscientious industries. Additionally, paper may be safely incinerated by the recipients of the products. Furthermore, paper protective packaging material is perfect for particle-sensitive merchandise, as its clean dust-free surface is resistant to static cling.

While paper in a sheet-like form could possibly be used as a protective packaging material, it is usually preferable to convert sheet-like stock material into a relatively low density pad-like cushioning product. This conversion may be accomplished by a cushioning conversion machine, such as those disclosed in U.S. Pat. Nos. 3,509,798; 3,603,216; 3,655,500; 3,779,039; 4,026,198; 4,109,040; 4,717,613; and 4,750,896, and copending U.S. patent application Ser. Nos. 07/592,572 and 07/712,203. The entire disclosures of these patents and applications, which are owned by the assignee of the present application, are hereby incorporated by reference.

In a typical cushioning conversion machine, a sheet-like stock material will form the starting material for the conversion process and this stock material will usually be composed of one or more layers of paper. Each of these layers, and thus the stock material itself, may be viewed as having two lateral edge sections and a central section therebetween. The cushioning conversion machine will generally include a conversion assembly for converting the sheet-like stock material into a cushioning product and a supply assembly which supplies the sheet-like stock material to the conversion assembly. The design of most stock supply assemblies results in the stock material being supplied to the conversion assembly in such a manner that its lateral edge sections must travel in a longer path than its central section whereby tension is created in the edge sections. If this "edge-tension" reaches a certain magnitude, a continuous tear is formed in one or more layers of the stock material which, understandably, inhibits the ability of the conversion assembly to create an acceptable cushioning product.

Applicants attempted to eliminate this "continuous tear" problem by artificially increasing the "central" path between the stock supply assembly and the conversion assembly whereby any tension would be shifted from the edge sections to the central section. This approach was based on the theory that if the central section of the stock material had to travel the same distance as the edge sections, the edge-tension, and therefore the continuous tearing, would be eliminated. Applicants postulated correctly in one regard as this solution did indeed eliminate edge tension and continuous tearing in the stock material. However, the quality of the cushioning product subsequently created from this "edge-tension free" stock material was unsatisfactory. The unacceptable nature of this "edge-tension free" cushioning product is believed to be due to the fact that a certain amount of edge-tension is essential to the proper conversion of the stock material into the cushioning product. In other words, a minimum "conversion-tension" is necessary in the edge sections of the stock material to properly convert the stock material into a cushioning product.

According to the present invention, the "continuous-tear" problem is solved by controlling, rather than eliminating, the tension in the edge sections of the stock material. Specifically, the edge-tension is controlled so that it is greater than or equal to the minimum conversion-tension and less than the continuous tearing-tension. In this manner, continuous tears are eliminated without sacrificing the quality of the created cushioning product.

More particularly, the present invention provides a cushioning conversion machine for converting a sheet-like stock material, which may be viewed as having two edge sections and a central section therebetween, into a cushioning product. The machine includes a conversion assembly for converting the sheet-like stock material into a cushioning product and a supply assembly which supplies the sheet-like stock material to the conversion assembly. The stock material is supplied to the conversion assembly in such a manner that its edge sections must travel in a longer path than the central section thereby creating tension in the edge sections. While a certain minimum conversion-tension is necessary in the lateral edge sections of the stock material to properly convert the stock material into a cushioning product, a certain continuous tearing-tension, greater than the minimum conversion-tension, will cause a continuous tear in the stock material. To insure that the edge-tension is not so great as to cause continuous tearing but is great enough to allow proper conversion, the supply assembly includes an edge-tension controlling device which controls the edge-tension so that it is greater than or equal to the minimum conversion-tension and less than the continuous tearing-tension.

In the preferred embodiment, the edge-tension controlling device controls the edge-tension by creating openings in the stock material. More particularly, the edge-tension controlling device controls edge-tension by creating a series of unconnected tension-relieving tears between the ends sections and the central section of the sheet-like stock material. The device preferably includes a mounting shaft, a pair of edge rollers mounted on opposite ends of the shaft, and a central roller mounted on the shaft between the edge rollers. The rollers are dimensioned and arranged so that a sagging gap is created on each side of the central roller between it and the respective edge roller. In the tension-controlled conversion process, the stock material passes over the rollers whereby the edge rollers are positioned beneath the edge sections and the central roller and the sagging gaps are positioned adjacent the central section. The summation of the width of the edge rollers, the central roller, and the sagging gaps, approximately equals the width of the sheetlike material which in a typical embodiment would be thirty inches.

The edge-tension controlling device is designed so that when the stock material approaches the "continuous-tearing tension", a small tension-relieving tear will begin to form between the edge section and the central section. As the tension-relieving tear opens, the portion of the stock material adjacent the inner border of the tension-relieving tear sags off the respective edge roller into the adjacent sagging gap. In this manner, excessive tension is shifted to the central section of the stock material whereby any additional tearing is eliminated. One may appreciate that during a typical conversion process, the edge-tension controlling device will create a series of unconnected tension-relieving tears between the edge sections and the central section of the stock material.

The present invention provides these and other features hereinafter fully described and particularly pointed out in the claims. The following description and the annexed drawings set forth in detail a certain illustrative embodiment of the invention. However, this embodiment is indicative of but one of the various ways in which the principles of the invention may be employed.

DETAILED DESCRIPTION

Figure 1:
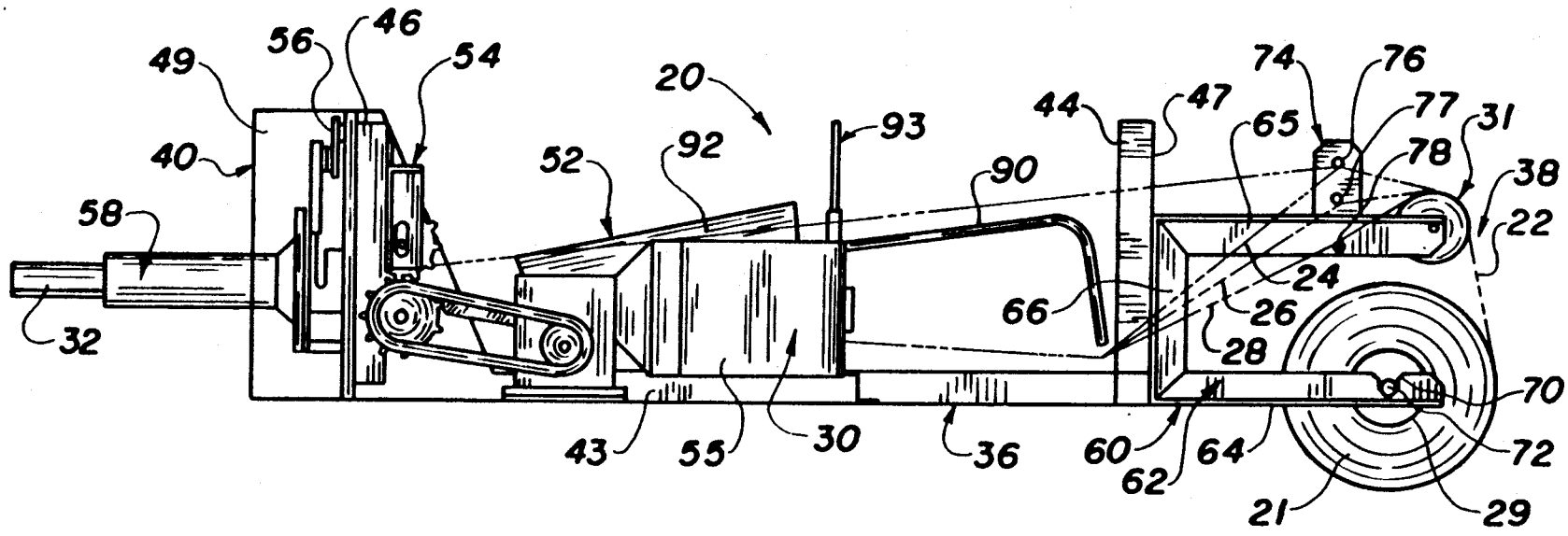
FIG. 1 is a side view of a cushioning conversion machine according to the present invention, the machine being shown loaded with a roll of a sheet-like stock material.

Turning now to the drawings in detail, a cushioning conversion machine according to the present invention is indicated generally at 20. In FIG. 1, the machine 20 is shown loaded with a roll 21 of sheet-like stock material 22 which preferably consists of three superimposed webs or layers 24, 26, and 28 of biodegradable, recyclable and reusable thirty-pound Kraft paper rolled onto a hollow cylindrical tube 29. For ease in explanation, each of these layers 24, 26, and 28, and thus the stock material 22 itself, may be viewed as including two lateral edge sections and a central section therebetween. It should be understood, however, that this sectioning of the stock material 22 is solely for analytical purposes and thus the stock material 22 will usually not have any physical characteristics reflecting such sectioning.

The relative size, shape, and arrangement of the sections of the stock material 22 will vary depending on the particular material being used, the approximate width of the material, and/or the design of the cushioning conversion machine However, when the preferred machine 20 and the preferred stock material 22 (which is approximately thirty inches wide) are used, certain approximate values may be assumed. More particularly, the edge sections may each be estimated as a longitudinal rectangular region which is approximately two inches wide and which is positioned adjacent the corresponding lateral side of the stock material. The central section will occupy the rectangular region therebetween which will be approximately twenty-six inches wide. The "length" of these sections will be coextensive with the length of the stock material 22.

As is explained in more detail below, the machine 20 includes conversion assemblies (hereinafter collectively referred to as "the conversion assembly 30") for converting the sheet-like stock material 22 into a cushioning product. In the initial phases of the conversion process, the stock material 22 is supplied to the conversion assembly 30 in such a manner that its edge sections must travel in a longer path than its central section thereby creating edge-tension in the stock material. While a certain minimum "conversion tension" is necessary in the edge sections to properly form the cushioning product, too much edge-tension may result in continuous longitudinal tears. According to the present invention, the cushioning conversion machine 20 includes an edge-tension controlling device which is indicated generally at 31 and which controls the edge-tension of the stock material 22. " Edge-tension controlling device" as used in this manner is intended to cover any device, whether or not it is structurally equivalent to the disclosed device 31, which controls edge-tension in a sheet-like stock material.

The conversion assembly 30 of the machine 20 is mounted on a frame assembly which is indicated generally at 36. The frame assembly 36 may be viewed as defining an upstream or "feed" end 38 and a downstream or "discharge" end 40. The terms "upstream" and "downstream" in this context are characteristic of the direction of flow of the stock material 22 through the machine 20. The frame assembly 36 is formed from a base plate 43 and two end plates 44 and 46. Although not perfectly apparent from the illustrations, the first or upstream end plate 44 includes a stock inlet opening 47 passing therethrough and the second or downstream end plate 46 includes a relatively small rectangular outlet opening 48. The frame assembly 36 also includes a box-like extension 49 which is removably attached to a downstream portion of the base plate 43.

The conversion assembly 30 of the machine 20 preferably includes a forming assembly 52, a gear assembly 54 powered by a gear motor 55, a cutting assembly 56 powered by a cutter motor 57, and a post cutting constraining assembly 58. These conversion assemblies are essentially identical to those disclosed in co-pending and co-owned U.S. patent application Ser. No. 07/592,572 to Armington et. al. which was filed on Oct. 5, 1990 and which is entitled "Downsized Cushioning Dunnage Conversion Machine and Packaging Systems Employing the Same." (The details set forth in this application regarding these conversion assemblies are hereby particularly incorporated by reference. The entire disclosure of this application has already been incorporated by reference). Nonetheless, other forms of conversion assemblies are possible with, and contemplated by, the present invention. Consequently, the term "conversion assembly" is hereby defined as any assembly or any collection of assemblies, regardless of whether it is structurally equivalent to the disclosed conversion assembly 30, which converts a sheetlike stock material into a cushioning product.

During the conversion process, the forming assembly 52 causes inward rolling of the lateral sides of the sheet-like stock material 22 to form a continuous strip having two lateral pillow-like portions and a central band therebetween. The gear assembly 54 performs a "pulling" function by drawing the continuous strip through the nip of the two cooperating and opposed gears of the gear assembly thereby pulling stock material through the forming assembly 52. The gear assembly 54 additionally performs a "coining" or "connecting" function when the two opposing gears coin the central band of the continuous strip as it passes therethrough to form a coined strip. As the coined strip travels downstream from the gear assembly 54 the cutting assembly 56 cuts the strip into sections 32 of a desired length. These cut sections 32 then travel through the post-cutting restraining assembly 58.

The stock material 22 is supplied to the conversion assembly 30 of the machine 20 by a stock supply assembly 60. "Stock supply assembly" in this context corresponds to any assembly, regardless of whether it is structurally equivalent to the disclosed stock supply assembly, which supplies the sheet-like stock material to the conversion assembly 30. In the illustrated and preferred embodiment, the stock supply assembly 60 includes two laterally spaced brackets 62 which are each generally shaped like a sideways "U" and have two legs 64 and 65 extending perpendicularly outward from a flat connecting base wall 66. The base wall 66 of each bracket 62 is suitably secured to the downstream side of the frame end plate 44, such that the leg 64 is generally aligned with the frame base plate 43. Both of the legs 64 have open slots 70 in their distal ends to cradle a supply rod 72. The supply rod 72 is designed to extend relatively loosely through the hollow tube 29 of the stock roll 21. As the stock material 22 is pulled through the machine 20 by the gear assembly 54 the tube 29 will freely rotate thereby dispensing the stock material 22.

The legs 65 of the U-brackets 62 extend from an intermediate portion of the frame end plate 44 and cooperate to mount a sheet separator, indicated generally at 74. The sheet separator 74 includes three horizontally spaced relatively thin cylindrical separating bars 76, 77 and 78. The number of separating bars, namely three, corresponds to the number of layers of the stock material 22. The sheet separator 74 separates the layers 24, 26 and 28 from each other prior to their passing to the forming assembly 52. The bracket legs 65 and more particularly their distal ends, also cooperate to support the edge-tension controlling device 31.

Consequently, when the stock material 22 is supplied to the conversion assembly 30, it is pulled from the stock roll 21 over the edge-tension controlling device 31 through the sheet separator 74, through the stock inlet opening 47 and into the forming assembly 52. The forming assembly 52 includes a three-dimensional bar-like shaping member 90, a converging chute 92, a transverse guide structure 93 and a "coining" or guide tray 94. The stock material 22 travels between the shaping member 90 and the frame base plate 43 until it reaches the guide tray 94. At this point, the transverse guide structure 93 and the guide tray 94 guide the stock material 22 longitudinally and transversely into the converging chute 92. During this downstream travel, the shaping member 90 rolls the lateral sides of the stock material 22 to form lateral pillow-like portions and the converging chute 92 coacts with the shaping member 90 to form a continuous strip of the desired geometry. As the strip emerges from the converging chute 92, the guide tray 94 guides the strip into the gear assembly 54.

Figure 2:
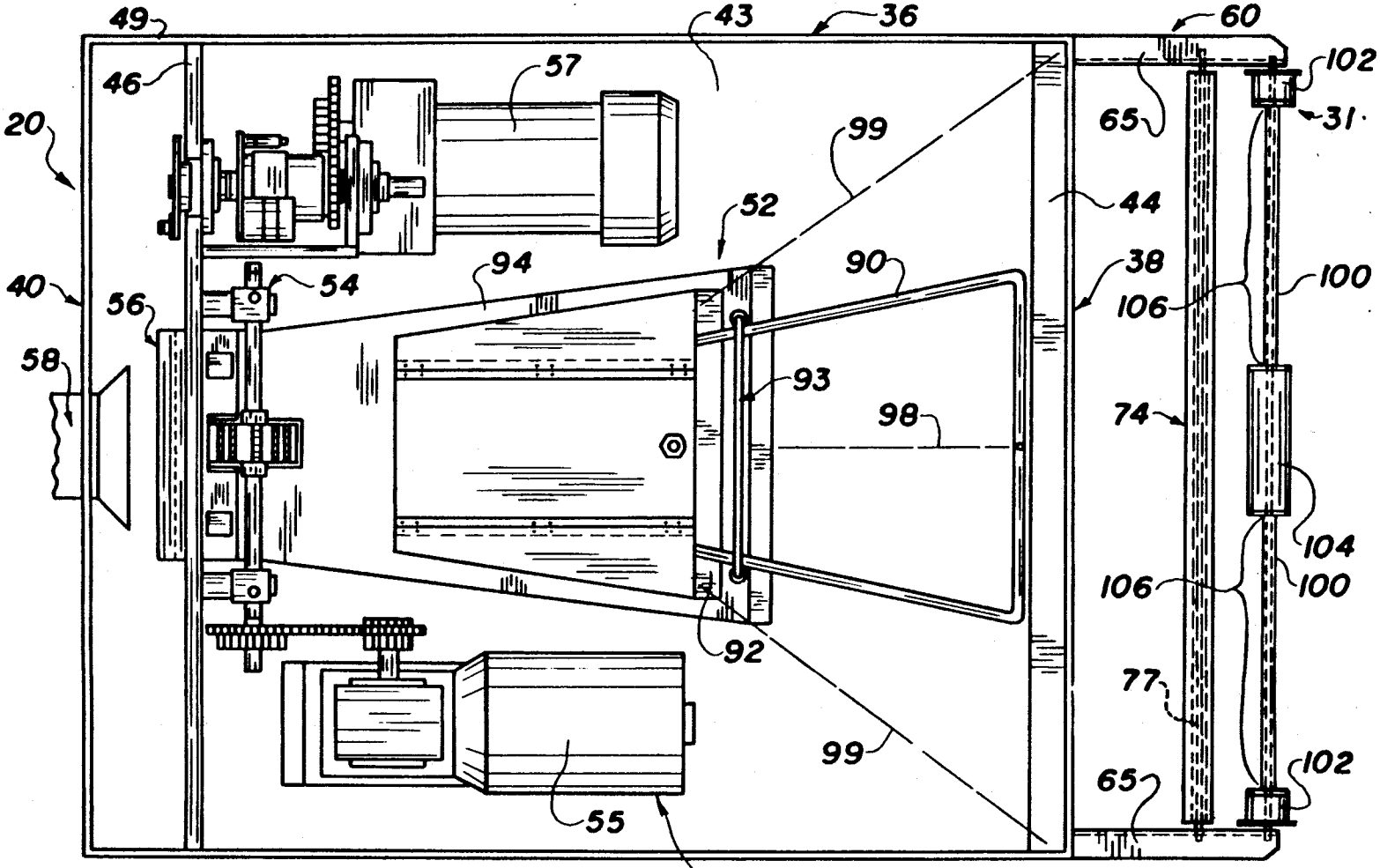
FIG. 2 is a top view of the cushioning conversion machine without the sheet-like stock material being loaded thereon.

As the stock material 22 travels from the stock-supply assembly 60 to the forming assembly 52, the central sections of the layers 24, 26 and 28 will travel in a substantially straight path as is indicated schematically by dashed line 98 in FIG. 2. However, the edge sections will travel in an inwardly slanted, and therefore longer, path such as is indicated schematically by dashed lines 99. The differences in the distances between the central and edge travel path results in "edge tension" being created in the edge sections of the stock material. While a certain minimum "conversion-tension" in the edge sections is essential to the conversion process, if the "edge-tension" reaches a certain magnitude, a continuous tear will be undesirably formed in one or more layers of the stock material 22. This magnitude of edge-tension may conveniently be called "continuous tear-tension".

Accordingly, the edge-tension controlling device 31 is designed to control the edge-tension so that it is greater than or equal to the minimum conversion-tension and less than the continuous tearing-tension. In the preferred embodiment, the device 31 performs this edge-tension controlling function by creating strategically spaced openings in the stock material. More particularly, the edge-tension controlling device 31 controls edge-tension by creating a series of unconnected tension-relieving tears between the end sections and the central section of the sheet-like stock material 22.

As is best seen in FIG. 2, the illustrated edge-tension controlling device 31 includes a mounting shaft 100 which is secured to the distal ends of the bracket legs 65. A pair of edge rollers 102 are rotatably mounted on opposite ends of the mounting shaft 100, and a central roller 104 is rotatably mounted on the shaft 100 therebetween. Although any suitable rigid material may be used to form the rollers 102 and 104, they are preferably made of schedule 80 polyvinylchloride (PVC) pipe. Additionally, the rollers are dimensioned and arranged so that a pair of "sagging gaps" 106 are created on opposite sides of the central roller 104 between it and the corresponding edge roller 102.

The rollers 102 and 104 are preferably cylindrical in shape and the shaft 100 preferably passes through the axial centers thereof. Consequently, the rollers each have of a substantially circular cross-sectional shape and the cross-sectional dimensions of the rollers are preferably approximately the same. More preferably, the diameter of each of the edge rollers 102 and the central roller 104 is preferably two and three-eighths inches.

Regarding the axial dimensions of the rollers, the sum of the widths of the edge rollers 102, the central roller 104, and the sagging gaps 106 preferably approximately equals the width of the sheet-like stock material 22. ("Width" in this context corresponds to the axial length of the cylindrical roller). The width of each of the edge rollers is preferably approximately two to seven percent of the width of the stock material and the width of the central roller is preferably approximately eighteen to twenty-five percent of the width of the stock material. More preferably, if the sheet-like stock material is thirty inches wide, the edge rollers are each approximately two inches wide and the central roller is approximately eight inches wide.

In the tension-controlled conversion process, the stock material 22, or more particularly the layers 24, 26 and 28, pass over the rollers as is shown in FIG. 1. When the stock material 22 is loaded into the machine 20 in this manner, the edge rollers 102 are positioned beneath the edge sections of the overlying stock material, and the central roller 104 and the sagging gaps 106 are positioned beneath the central section of the overlying stock material. Thus, the width of the edge rollers 102 is preferably chosen to correspond to the width of the edge sections of the stock material 22.

When the edge-tension of the stock material 22 approaches the "continuous-tearing tension", the device 31 is designed to create a small tension-relieving tear between the edge section and the central section of the stock material. As the tension-relieving tear opens the portion of the stock material 22 adjacent the inner border of the tension-relieving tear sags off the respective edge roller 102 into the adjacent sagging gap 106. In this manner excessive tension is shifted to the central section of the stock material 22 whereby any additional tearing is eliminated. Thus, during a typical conversion process, the edge-tension controlling device will create a series of unconnected tension-relieving tears between the edge sections and the central section of the stock material.

The stock supply assembly 60 of the present invention is essentially identical to that disclosed in U.S. patent application Ser. No. 07/592,572. However, the edge-tension controlling device 31 of the present invention replaces the "constant entry bar 80" described in this earlier application. Nonetheless, the device 31 also functions as a constant entry bar in that it provides a non-varying point of entry for the stock material 22 into the separator 74 and the forming assembly 52 regardless of the diameter of the stock roll 21. Thus when a different diameter roll is used and/or as dispensation of the stock material 22 from roll 21 decreases its diameter, the point of entry of the stock material 22 into the separator 74 remains constant.

One may now appreciate that the present invention solves the "continuous tear" problem without sacrificing the quality of the created cushioning product. Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A cushioning conversion machine for converting a sheet-like stock material, which may be viewed as having two edge sections and a central section therebetween, into a cushioning product, said machine comprising:

a conversion assembly which converts the sheet-like stock material into a cushioning product, and a supply assembly which supplies the sheet-like stock material to said conversion assembly;

wherein the stock material is supplied to said conversion assembly in such a manner that its edge sections must travel in a longer path than its central section thereby creating edge-tension in the stock material;

wherein a certain minimum conversion-tension is necessary in the edge sections of the stock material to properly convert the stock material into a cushioning product;

wherein a certain continuous tearing-tension, greater than said minimum conversion-tension, will cause a continuous tear in the stock material; and wherein said stock supply assembly includes an edge-tension controlling device which controls said edge tension by creating so that the edge tension is greater than or equal to said minimum forming-tension and less than said continuous tearing-tension.

2. A cushioning conversion machine as set forth in claim 1 wherein said edge-tension controlling device controls the edge-tension by creating a series of unconnected tension-relieving tears in the stock material between its end sections and its central section.

3. A cushioning conversion machine as set forth in claim 2 wherein said edge-tension controlling device includes a mounting shaft, a pair of edge rollers mounted on opposite ends of said shaft, and a central roller mounted on the shaft between said edge rollers.

4. A cushioning conversion machine as set forth in claim 3 wherein said rollers are dimensioned and arranged so that a sagging gap is created on each side of said central roller between it and the respective edge roller.

5. A cushioning conversion machine as set forth in claim 4 wherein a summation of the width of said edge rollers, the width of said central roller, and the width of said sagging gaps, approximately equals the width of the sheet-like stock material.

6. A cushioning conversion machine as set forth in claim 5 wherein the width of each of said edge rollers is approximately equal to two to seven percent of said summation.

7. A cushioning conversion machine as set forth in claim 6 wherein the width of said central roller is approximately equal to eighteen to twenty-five percent of said summation.

8. A cushioning conversion machine as set forth in claim 7 wherein said edge rollers and said central roller are cylindrical in shape whereby they each have a substantially circular cross-sectional shape.

9. A cushioning conversion machine as set forth in claim 8 wherein the diameters of said edge rollers and said central roller are approximately equal.

10. A cushioning conversion machine as set forth in claim 9 wherein the diameters of said edge rollers and said central rollers are each approximately equal to two and three-eighths inches.

11. A cushioning conversion machine as set forth in claim 10 wherein said rollers are made of polyvinylchloride.

12. A cushioning conversion machine as set forth in claim 11 wherein said rollers are rotatably mounted to said mounting shaft.

13. A cushioning conversion machine as set forth in any of claims 12 wherein said conversion assembly comprises:

a forming assembly which causes inward rolling of the lateral sides of the sheet-like stock material into a generally spiral-like form whereby a continuous unconnected strip having two lateral pillow-like portions separated by a thin central band is formed;

a pulling/connecting assembly which pulls such stock material from said stock supply assembly through said forming assembly to form a continuous unconnected strip and which connects such continuous unconnected strip along such central band whereby a coined strip of a pad-like cushioning product is formed; and a cutting assembly which cuts such coined strip into cut sections of a desired length.

14. A method of using the machine set forth in claim to convert a sheet-like stock material into a cushioning product, said method comprising the steps of:

providing a sheet-like stock material having two edge sections and a central section therebetween;

providing a conversion assembly for converting the sheet-like material stock material into the cushioning product;

supplying the sheet-like stock material to the conversion assembly in such a manner that its edge sections must travel in a longer path than its central section whereby edge-tension is created in the stock material; and controlling the edge-tension in the stock material by creating openings therein.

15. A cushioning conversion machine for converting a sheet-like stock material, which may be viewed as having two edge sections and a central section, into a cushioning product, said machine comprising:

a conversion assembly which converts the sheet-like stock material into a cushioning product, and a supply assembly which supplies the sheet-like stock material to said conversion assembly;

wherein the stock material is supplied to said conversion assembly in such a manner that its edge sections must travel in a longer path than its central section thereby creating edge tension in the stock material; and wherein said stock supply assembly includes a tension-controlling device which controls said edge tension by creating a series of unconnected tension-relieving tears in the stock material between its end sections and its central section.

16. A method of converting a sheet-like stock material into a cushioning product, said method comprising the steps of:

providing a sheet-like stock material having two edge sections and a central section therebetween;

providing a conversion assembly for converting the sheet-like material stock material into the cushioning product;

supplying the sheet-like stock material to the conversion assembly in such a manner that its edge sections must travel in a longer path than its central section whereby edge-tension is created in the stock material; and controlling the edge-tension in the stock material by creating openings therein.

17. A method as set forth in claim 16 wherein said step of controlling includes the step of creating a series of unconnected tension-relieving tears in the stock material between its end sections and its central section.

* * * * *